US007509757B2

(12) United States Patent
Monsees et al.

(10) Patent No.: US 7,509,757 B2
(45) Date of Patent: Mar. 31, 2009

(54) SINGLE-PULL BINDING FOR A SNOWSHOE

(75) Inventors: James Monsees, Menlo Park, CA (US); Daniel T. Emerson, Berkeley, CA (US)

(73) Assignee: K-2 Corporation, Seattle, WA (US)

( * ) Notice: Subject to any disclaimer, the term of this patent is extended or adjusted under 35 U.S.C. 154(b) by 602 days.

(21) Appl. No.: 11/335,186

(22) Filed: Jan. 18, 2006

(65) Prior Publication Data

US 2007/0163153 A1 Jul. 19, 2007

(51) Int. Cl.
*A43B 5/04* (2006.01)

(52) U.S. Cl. ..... 36/122

(58) Field of Classification Search ..... 36/122–125
See application file for complete search history.

(56) References Cited

U.S. PATENT DOCUMENTS

| | | | | |
|---|---|---|---|---|
| 919,118 | A | 4/1909 | Blacklock | |
| 5,440,827 | A | 8/1995 | Klebahn et al. | |
| 5,687,491 | A | 11/1997 | Klebahn | |
| 5,740,621 | A | 4/1998 | Wing et al. | |
| 5,918,387 | A * | 7/1999 | Emerson | 36/122 |
| 6,374,518 | B2 | 4/2002 | Warner | |
| 6,401,310 | B1 | 6/2002 | Warner et al. | |
| 6,526,629 | B1 | 3/2003 | Warner et al. | |
| 6,694,645 | B2 | 2/2004 | Messmer et al. | |
| 6,694,646 | B2 * | 2/2004 | Messmer et al. | 36/122 |
| 2003/0126766 | A1 * | 7/2003 | Messmer et al. | 36/122 |
| 2004/0231200 | A1 * | 11/2004 | Forrest et al. | 36/122 |
| 2005/0183291 | A1 * | 8/2005 | Kiniry et al. | 36/122 |
| 2007/0163151 | A1 * | 7/2007 | Monsees et al. | 36/122 |

FOREIGN PATENT DOCUMENTS

| | | |
|---|---|---|
| EP | 0786274 | 7/1997 |
| FR | 2419086 | 10/1979 |
| WO | WO03099396 | 12/2003 |

* cited by examiner

*Primary Examiner*—Marie Patterson
(74) *Attorney, Agent, or Firm*—Thomas M. Freiburger

(57) ABSTRACT

A boot binding for a snowshoe, suspended within the snowshoe for flexibility of the boot relative to the snowshoe in the pitch direction, has a binding footbed that is flexible and allows bending of the boot in the pitch directed, as steps are taken by the user.

15 Claims, 3 Drawing Sheets

SINGLE-PULL BINDING FOR A SNOWSHOE

BACKGROUND OF THE INVENTION

This invention concerns snowshoes of the type having a boot binding secured to the snowshoe, either permanently or by attachment. Specifically the invention concerns a snowshoe binding with a system of straps easily tightened by the wearer, including a heel strap connected to an arch area strap such that tightening the arch strap draws the heel strap tight.

Snowshoe bindings, and bindings for cleats or other terrain-engaging footgear, are shown in Atlas Snowshoe Co. U.S. Pat. Nos. 5,440,827, 5,918,387, 6,374,518, 6,401,310, 6,526,629, 6,694,645 and 6,694,646. U.S. Pat. No. 5,687,491 disclosed a contoured footbed in a boot binding (the term "boot" as used herein refers to a boot or a shoe). U.S. Pat. No. 6,694,646 disclosed a snowshoe harness with buckles and straps configured such that a single pull can tighten the harness down to the boot, and including toe area and arch area straps whose tails were connected together as a loop, such that the user need only pull on the loop. As shown in nearly all the above listed patents, a heel strap is provided to secure the user's boot in the binding, to prevent against pulling back of the boot from the tightened toe and arch areas on the binding during use of the snowshoe or cleat device.

U.S. Pat. No. 6,694,646 described a snowshoe binding with a versatile, adjustable, convenient and efficiently used means for tightening toe and arch straps. That binding system works well, but it would be desirable to allow the user to tighten the heel strap at the same time as tightening one or both of the arch and toe straps, thus to avoid the need for the twisting and bending motion involved in drawing tight a heel strap.

Atlas Snowshoe Co. U.S. Pat. No. 6,694,645 shows a lace binding for a snowshoe wherein the lace tightens harness webbing over the top of the boot and also pulls tight a heel strap.

SUMMARY OF THE INVENTION

Pursuant to this invention, a binding for a snowshoe or other terrain-engaging sport wear includes a heel strap that is connected to at least an arch area strap, so that a pull to tighten the arch area strap draws the heel strap tight. In a preferred embodiment the arch area and toe straps of the binding have tail ends connected together to form a single loop that tightens both, as in the '646 patent discussed above, and with the arch area strap continuing through guides in the binding harness to serve as a heel strap. Thus, a single pull by the user on the loop tightens both over-the-boot straps and also the heel strap. The harness shell to which the straps are attached can be formed similarly to that of the '646 patent, but with one or more strap guide slots for continuing the arch area strap to extend into the heel strap, rather than having the arch strap fixed to the binding shell or webbing at that location. In addition, the binding shell preferably has a strap guide extension extending back toward the heel, to help hold the heel strap in position, and a further flexible but relatively stiff strap guide is included at the opposite side of the binding, secured to or enclosing the heel strap at such opposite side so as to hold the heel strap in a generally horizontal position and ready for the user to step a boot into the binding and to engage the strap system without having to manually position the heel strap.

The binding can additionally include a flexible footbed, with flexibility for bending at the metatarsal phalangeal joint of the foot. The footbed in this embodiment is only rigid at the toe area, forward of the metatarsal phalangeal joint location (where it is secured to a toe cleat), and the over-the-boot strap in the arch region is connected to the back portion of a flexibly compliant footbed element. The footbed can also include a sliding width adjustment at the arch.

In one particular embodiment the snowshoe binding of the invention comprises a footbed for engagement against the bottom of a user's shoe or boot and adapted for securing to a snowshoe, with a boot binding extending up from the footbed, the binding at one side having a shaped, flexible harness shell adapted to engage the shoe or boot at the side and at least partially over the top of the shoe or boot. At an opposite side of the binding is another flexible harness element.

A first flexible strap is fixed to the one side at the footbed, extending to the other side and looping through the flexible harness element, then returning back toward the harness shell and being engaged in and passing through an adjustable locking buckle connected to the flexible harness shell.

A second flexible strap is connected at said other side to the footbed and crosses generally to a position above the arch area to a second adjustable locking buckle connected to the flexible harness shell.

A heel strap extends back from the boot binding in a generally horizontal loop, fixed to the boot binding at one side and held in place by a guide or stiffener. The heel strap at the opposite side is secured to (and can be continuous with) the second flexible strap, and can be held by a slip-through slide guide on the binding, whereby tightening of the second flexible strap generally over the arch area is effective simultaneously to tighten the heel strap.

Preferably the two straps, for the toe area and arch area, are connected at their tail ends to form a grippable handle extending generally between the two buckles, capable of being pulled by the user to draw both straps with one pull, such that the pulling of the strap handle effects tightening of the toe area, the arch area and the heel. In a preferred form, all straps comprise one continuous strap.

In one specific embodiment of the invention the width of the snowshoe binding and strap engagement against the boot in the arch area are adjustable, preferably via a simple lateral slide mechanism, to accommodate boots of different widths. The arch region strap and an adjustment buckle for the strap are so arranged that the pulling of the arch region strap to tighten the binding will tend to pull the slide adjustment device into contact with the sides of the boot as the strap is tightened.

It is thus among the objects of the invention to improve on boot bindings for snowshoes or other terrain-engaging footgear, such as snow cleats or ice cleats, by providing for greater convenience and ease of use in tightening the binding on the user's boot. These and other objects, advantages and features of the invention will be apparent from the following description of preferred embodiments, considered along with the accompanying drawings.

DESCRIPTION OF PREFERRED EMBODIMENTS

Figure 1:
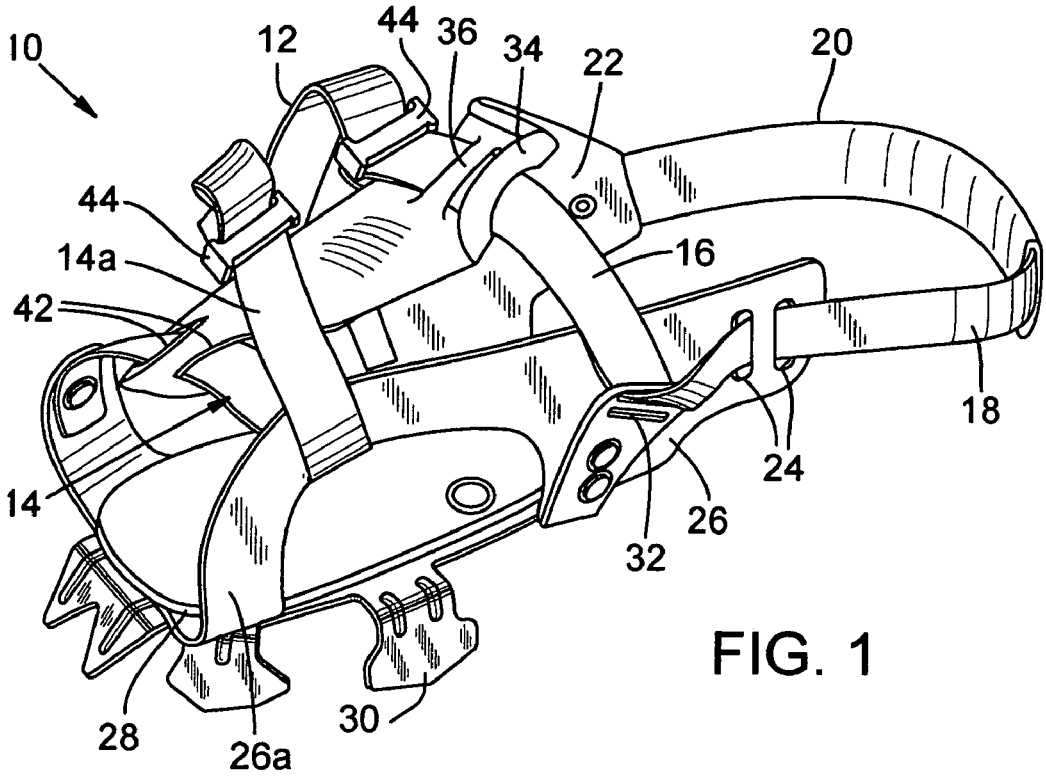
FIG. 1 is a perspective view showing a snowshoe binding of the invention, shown detached from a snowshoe.

In the drawings, FIG. 1 shows a binding 10 for retaining a user's shoe or boot ("boot" herein), either in a snowshoe to which the binding is attached, or simply as a cleat for walking on icy terrain or densely packed snow. The binding 10 as shown in FIG. 1 is a preferred and specific embodiment of the invention, wherein a single pull of a loop 12 will tighten straps 14, 14*a* (generally in the toe area of the boot) and 16 (generally in the arch area of the boot), as well as a heel strap 18, with a single pull. The strap arrangement is generally similar to that shown in the '646 patent referenced above, although this can vary if desired. The most important feature of the invention is that the heel strap 18 is connected to the arch area strap 16, preferably comprising a single continuous strap for both the heel and the arch area. The heel strap is supported in position, even when not tightened against a user's boot, by a strap support and stiffening device 20, which may be fixed to the heel strap 18 as a stiffener (still allowing the needed flexibility to bend around the heel) or which can be a tube element as shown, with the strap 18 inside. The strap support/stiffener 20 is connected onto a harness shell or webbing element 22 to extend back therefrom, as shown in the drawing. This holds the strap 18 in a generally horizontal loop as shown, the strap 18 passing through one or more strap guide slots 24 in an opposite side of the boot binding or harness shell 26. The harness shell or webbing element 26 preferably is integral with the component 22 at the one side, as can be seen in the drawing, the unitary flexible element 22/26 being fixed down to a footbed 28 and metal cleat 30. The preferably plastic harness shell element 22/26 can be a layer between the cleat 30 and the footbed 28 as shown, with rivets or bolts securing this three-layer sandwich construction together.

The stiffener or guide sleeve 20 is flexible so as to bend around the back end of the boot and to conform to the boot as needed, but is relatively stiff in the other direction of bending, such that it reliably holds the strap in the generally horizontal loop position shown, and the user need only step the boot into the binding, once the straps are sufficiently loosened, then pull the strap handle loop 12 to tighten the heel strap along with the over-the-boot straps.

In the form shown, the strap or strap portion 16 is further guided by a slotted guide piece 32 secured to the harness element 26, and this guide 32 along with the one or more slot guides 24 serve to transition the strap in its sliding movement from the arch area portion 16 to the heel strap 18, allowing for smooth tightening and loosening of the heel strap when the strap 16 is tensioned.

In U.S. Pat. No. 6,694,646, which is fully incorporated herein by reference, the looped strap handle arrangement was similar, except that the arch area strap, in the position of the strap 16, was fixed to a portion of the boot binding or harness shell, rather than continuing into the heel strap.

It should be understood that the snowshoe binding 10 of the invention can be made, if desired, without the loop 12 connecting the tail ends of the forward and rear straps 14 and 16. Although the single-pull loop form is preferred, a rear strap or arch area strap 16, independent of the forward strap 14, and which connects with or is continuous with a heel strap 18 such that tightening of the arch area strap also tightens with the heel strap, is within the principles of the invention.

Figure 2:
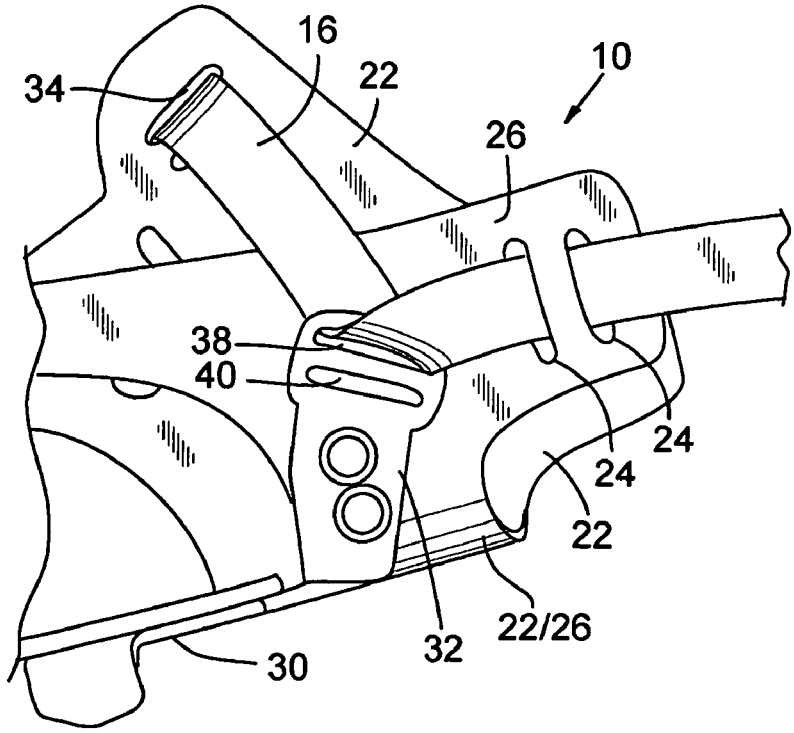
FIG. 2 is a detail view in side elevation showing a portion of the same side of the snowshoe binding.

As can be seen from FIGS. 1 and 2, other guide slots or loops 34 and 36 are configured so as to allow smooth travel of the strap 16 upon tightening or loosening. The strap guide 32 is seen in better detail in FIG. 2, showing its slotted opening 38 for the strap 16, and also indicating a second, parallel slot 40 for different positioning of the strap if needed for better adjustment or slidability.

FIG. 1 shows that forward strap 14, 14*a* passes through slots 42 at or near the front end of the harness shell element 22, to guide and hold in position the strap 14 near its forward end, and that the strap 14 passes around a flexible harness element 26*a*, through an opening provided by the flexible harness element, in the same manner as disclosed in the '646 patent. These attachments of the forward strap portion provide for versatility in fitting to a user's boot, with the ability of the harness shell to open or close around boots of different sizes and the ability of the strap 14/14*a* to be positioned more forward or more rearward along the flexible harness element 26*a* as needed for the particular boot configuration.

Strap buckles 44 may comprise cam lock buckles as disclosed in the '646 patent, which can be generally of the type shown in U.S. Pat. No. 6,526,629. Alternatively, these buckles can comprise other types of slip-through adjustable locking buckle, well known in the art.

As mentioned above, the snowshoe binding 10 of the invention can include a flexible footbed, if desired, as disclosed in co-pending application Ser. No. 11/335,848. Such a flexible footbed, which can be formed of plastic, is secured to the metal cleat member 30 only at the forward end of the footbed, allowing the user to bend the boot and foot at the metatarsal phalangeal joint, thus making use of the snowshoe or terrain-engaging device much more comfortable. In that case the rear portion of the footbed "floats", relative to the metal cleat 30, and the binding elements 22, 26 and the straps move along with the rear portion of the footbed.

Figure 3:
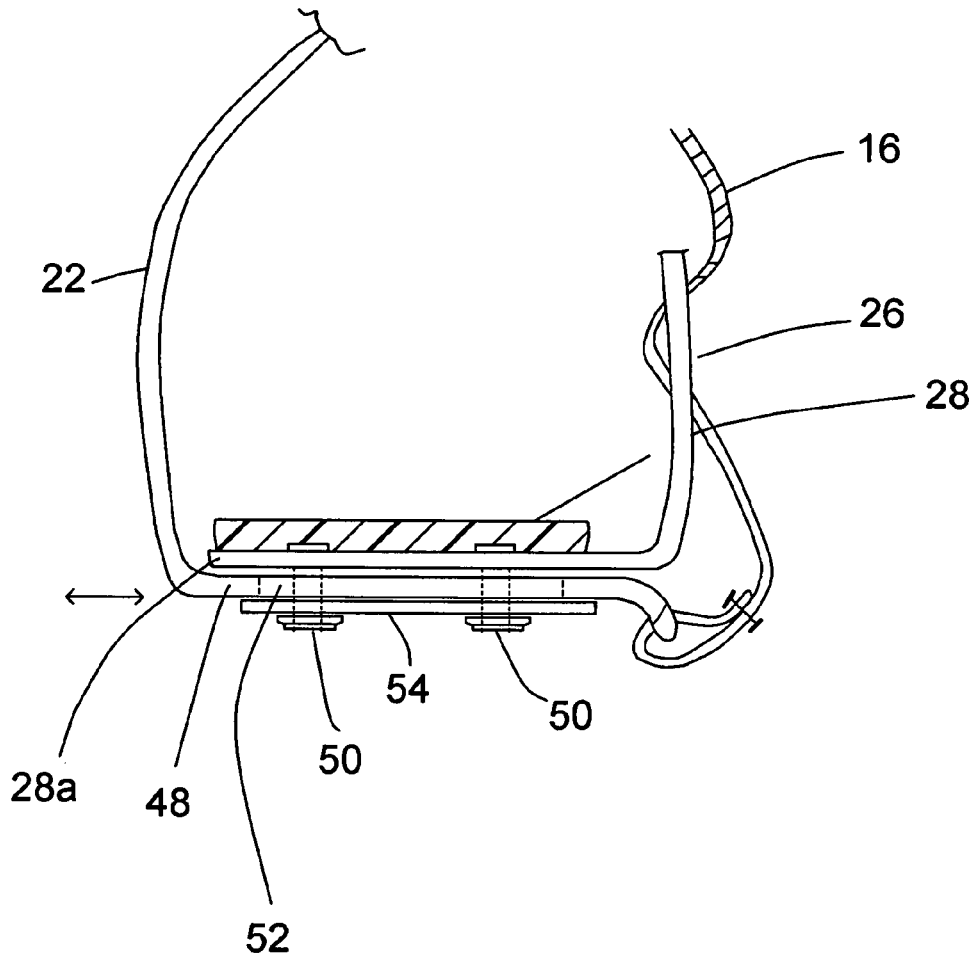
FIG. 3 is a detail view in cross section showing a laterally slidable adjustment at or near the arch area of the binding, as can be included in an embodiment of the invention.

In addition, as also described in the referenced co-pending application, the arch area of the footbed can include a slidable width adjustment if desired. With such a width adjustment, the two opposed portions 22 and 26 of the harness shell are actually separate pieces, slidable toward and away from one another at the rear or arch region via a simple sliding element. Tightening of the rear strap 16 and the heel strap 18 has the effect of sliding the width adjustment device together, to engage the boot at the desired width. A detail of such a slide adjustment is shown in the transverse sectional view of FIG. 3. In FIG. 3 a sliding element 48, which is secured to or part of the harness element 22, is seen retained by a pair of fasteners 50, which extend through a slot 52 of the slider 48 and are engaged through the flexible footbed element 28*a* at the top and to a retaining strip 54 at the bottom. This allows the sliding piece 48 to slide laterally for width adjustment without much friction. The user's boot is inserted into the binding with the sliding element pulled out to maximum width (to the left in FIG. 3). When the straps are tightened using the loop pull 12 (FIG. 1), or otherwise using the arch area strap 16, this pulls the sliding element 48 inward, along with the harness shell element 22, so that the harness element 22 engages snugly against the side of the boot.

It should be understood that the harness shell 22 and harness element 26 shown in the drawings and discussed above need not be configured as shown. Some type of transitioning strap-passing device is needed for transitioning the strap between the arch area strap 16 and the heel strap 18, and this element should be attached to the footbed, but the remainder of the harness element 26 can be configured otherwise. For example, the front strap 14, 14*a* could merely pass through a slide loop at the side of the footbed rather than through the arching loop portion 26*a* as shown. Further, the strap portion 14*a* could simply be fixed to the footbed at the near side of the binding as seen in FIG. 1. The harness shell 22 could be a much smaller device, sufficient to suspend the heel strap with a stiffening element, but the straps 14*a*, 16 could be relied on to engage over the boot, without such an extensive harness shell. The buckles 44 could merely be secured to fixed straps fixed down to the one side of the footbed (the far side as seen in FIG. 1).

Figure 4:
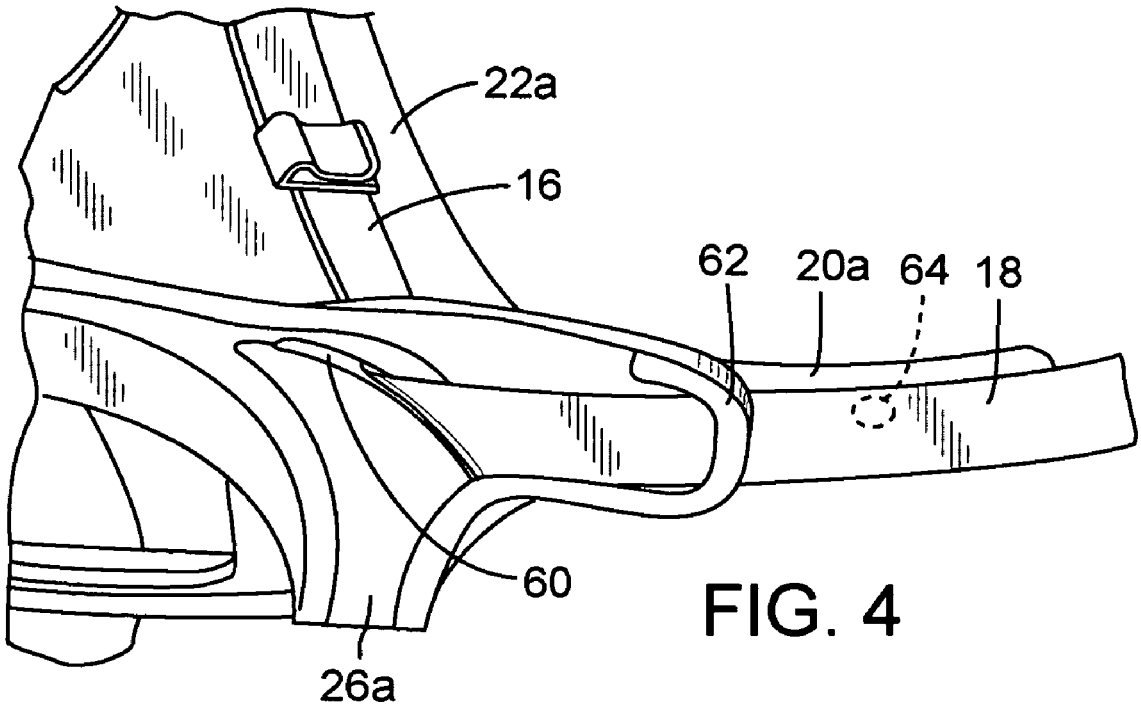
FIG. 4 is a detail view in side elevation showing a modification of what is shown in FIG. 2.

FIG. 4 shows an alternative to FIGS. 1 and 2 in the strap slide arrangement. Here, the arch area strap portion 16 transitions to the heel strap portion 18 through a preferably arch-shaped slot 60 formed toward the rear in the binding element 26*a*, then through a slide loop 62 integrally formed in the same element 26*a*, at the rear of the element. This avoids the need for the strap guide 32 attached to the side of the binding element as described above. The slot 60 and the formed slide loop 62 are shaped in a way to guide the strap or along a direct path and with as little friction as possible. The binding element or harness shell 26*a* may be formed of a rubbery plastic or thermoplastic such as SEBS or other suitable material. If desired a grommet or coating of a lower-friction, stiffer plastic could line the slot 60 for reducing friction further. The slot 60 is elongated and configured preferably as an arch, to accommodate the angulation of the strap 16 as it passes through the slot, requiring a wider space and to allow for differences in position of the strap 16 due to different positions of the harness shell for different shoe sizes.

A heel strap stiffener 20*a* is also visible in FIG. 4, similar to the heel strap stiffener 20 but in this case simply comprising a rear extension of the flexible harness shell 22*a*, on the opposite side of the binding from the slot 60 and the guide 62. The strap stiffener 20*a* is a formed extension of the shell, and end of the strap portion 18 is simply secured to this harness shell extension 20*a* near its end, as by a rivet. The approximate connection is shown, as an example, at 64 in dashed lines, being on the opposite side of the binding from the strap portion 18 visible in FIG. 4. As in the above described heel strap stiffener 20, the device 20*a* holds the heel strap in position for entry of a boot into the binding so as to avoid the need for manual positioning of the heel strap by the user.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A snowshoe binding, comprising:

a footbed for engaging against the bottom of a user's boot and adapted for securing to a snowshoe, boot binding elements extending up from the footbed, with flexible means connecting a pair of slip-through type adjustment buckles to one side of the footbed, one adjustment buckle being forward near a toe area of the boot and the other being to the rear, generally near the arch area of the boot, strap means connected to the footbed and passing through the adjustment buckles, for enabling tightening of the snowshoe binding snugly over a user's boot, both over the general toe area of the boot and the general arch area of the boot, with a single pull on an intermediate portion of the strap means, between the two buckles, and a flexible heel strap extending in a rearward loop on the binding, the heel strap comprising a continuation of the strap means, and the binding elements including strap guiding and positioning means extending from the one side of the arch area and supporting the heel strap through a portion of the strap loop so as to hold the heel strap in place when a user inserts a boot, whereby a single pull on said intermediate portion of the strap means is effective to tighten the strap means at the toe area and the heel area and also to tighten the heel strap.

2. The snowshoe binding of claim 1, wherein the strap means comprises a single continuous strap.

3. The snowshoe binding of claim 1, wherein the binding elements and the flexible means comprise a flexible harness shell extending up from the one side of the footbed and generally to a position over the top of the boot, the two buckles being secured to the flexible harness shell.

4. The snowshoe binding of claim 1, wherein the binding elements include a strap slide guide where the heel strap is connected to the footbed at said opposite side of the arch area, for transitioning the strap from the arch area to the heel strap.

5. A snowshoe binding, comprising:

a footbed for engagement against the bottom of a user's shoe or boot and adapted for securing to a snowshoe, a boot binding extending up from the footbed, the binding at one side having a shaped, flexible harness shell adapted to engage the shoe or boot at the side and at least partially over the top of the shoe or boot, strap means and buckle means connected to the footbed and to the flexible harness shell, for enabling tightening of the harness shell snugly over a user's boot, both over the toe area of the boot and the arch area of the boot, with a single pull on an intermediate, handle portion of the strap means which is effective to draw tension in end portions of the strap means, such tension being retained in the end portions by said buckle means located at spaced positions at either side of said intermediate, handle portion of the strap means, and a flexible heel strap extending in a rearward loop on the binding, the heel strap comprising a continuation of the strap means and the binding elements including a strap guide where the strap is connected to the footbed at one side of the arch area, and including strap guiding and positioning means extending from an opposite of the arch area and supporting the heel strap through a portion of the strap loop so as to hold the heel strap in place when a user inserts a boot, whereby a single pull on said intermediate portion of the strap means as effective to tighten the strap means at the toe area and the heel area and also to tighten the heel strap.

6. The snowshoe binding of claim 5, wherein the buckle means comprises a pair of slip-through adjustable locking buckles secured to the harness shell and ultimately to the footbed at said one side, one buckle being adjacent to the toe area of the boot as the other being over the arch area, and the intermediate portion of the strap means being between two buckles.

7. The snowshoe binding of claim 6, wherein the strap means comprises a single continuous strap.

8. A snowshoe binding, comprising:

a footbed for engagement against the bottom of a user's shoe or boot and adapted for securing to a snowshoe, a boot binding extending up from the footbed, the binding at one side having a shaped, flexible harness shell adapted to engage the shoe or boot at the side and at least partially over the top of the shoe or boot, a first flexible strap connected to an opposite side of the footbed, and extending toward the harness shell and being engaged in and passing through an adjustable locking buckle connected to the flexible harness shell, a second flexible strap connected at said opposite side to the footbed and crossing to a position generally above the arch area to a second adjustable locking buckle connected to the flexible harness shell, and a heel strap extending in a generally horizontal loop, back from the boot binding, the heel strap being fixed to the boot binding at the one side and held by a slide guide on the boot binding at the opposite side, the heel strap at said opposite side being secured to the second flexible strap, whereby tightening of the second flexible strap generally over the arch area is effective simultaneously to tighten the heel strap.

9. The snowshoe binding of claim 8, wherein the two straps are connected in a grippable handle extending generally between the two buckles, and capable of being pulled by a user to draw both straps with one pull, the tightening of the first and second straps being effective to pull the flexible harness shell into engagement against the boot as well as being effective to tighten the heel strap.

10. The snowshoe binding of claim 8, wherein at said opposite side of the binding an arch loop extends from near the front of the footbed in a sweeping arch generally to the back of the footbed and has a rear portion positioned to engage against the arch of a user's boot to add stability and prevent boot rotation, said opposite side thus being adapted to receive the inner side of the boot and foot, the first strap being connected to the arch loop.

11. The snowshoe binding of claim 10, wherein the first strap is connected to the arch loop by looping over the arch loop and generally reversing direction to extend back to a fixed connection with the footbed at said one side of the binding.

12. The snowshoe binding of claim 8, wherein the first and second straps comprise a single integral strap which is continuous from buckle to buckle and continuous with the heel strap.

13. The snowshoe binding of claim 8, including a heel strap stiffener extending from the one side of the binding through a portion of the generally horizontal loop of the heel strap, to hold the heel strap in position for entry of a boot into the binding thus avoiding the need for manual positioning of the heel strap by the user.

14. The snowshoe binding of claim 13, wherein the heel strap stiffener comprises an integrally formed rear extension of the flexible harness shell, to which the end of the heel strap is secured.

15. The snowshoe binding of claim 8, wherein the slide guide on the foot binding comprises an elongated, slotted opening in the side of the harness shell that's at one side and a guide loop rear of the slot opening, formed integrally on the harness shell on the second flexible strap and the heel strap comprising a single flexible strap.

* * * * *